US007178432B1

(12) United States Patent
Han et al.

(10) Patent No.: US 7,178,432 B1
(45) Date of Patent: Feb. 20, 2007

(54) METHODS, DEVICES AND SYSTEMS FOR SCREW FEEDING BY VACUUM AND GRAVITY

(75) Inventors: Tan Jit Han, Petaling Jaya (MY); Mandeep Singh, Petaling Jaya (MY)

(73) Assignee: Western Digital Technologies, Inc., Lake Forest, CA (US)

( * ) Notice: Subject to any disclaimer, the term of this patent is extended or adjusted under 35 U.S.C. 154(b) by 37 days.

(21) Appl. No.: 11/289,847

(22) Filed: Nov. 30, 2005

(51) Int. Cl.
*B25B 23/04* (2006.01)
*B65H 5/00* (2006.01)

(52) U.S. Cl. ..... 81/430; 81/433; 227/112

(58) Field of Classification Search ..... 81/57.37, 81/430, 431, 433; 227/112, 119, 139
See application file for complete search history.

(56) References Cited

U.S. PATENT DOCUMENTS 3,583,451 A 6/1971 Dixon et al.
4,495,841 A * 1/1985 Mori et al. ..... 81/430
4,627,316 A 12/1986 Mori et al.
4,922,436 A 5/1990 Dohm et al.
4,924,732 A 5/1990 Hoskins et al.
4,955,476 A 9/1990 Nakata et al.
5,090,103 A 2/1992 Nakata et al.
5,480,087 A * 1/1996 Young et al. ..... 227/112
6,418,818 B1 7/2002 Tham et al.
6,497,036 B1 12/2002 Jenkins et al.
6,543,119 B2 4/2003 Jenkins et al.
6,681,659 B2 1/2004 Hoe et al.
6,945,140 B2 * 9/2005 Gibbons et al. ..... 81/57.37
2001/0035087 A1 * 11/2001 Subotnick ..... 84/600
2005/0039580 A1 * 2/2005 Gibbons et al. ..... 81/57.37

* cited by examiner

*Primary Examiner*—Jacob K. Ackun, Jr.
(74) *Attorney, Agent, or Firm*—Jason T. Evans, Esq.; Young Law Firm

(57) ABSTRACT

An electric screwdriver with automatic screw feeding includes a shaft defining a bit; a body portion, the body portion defining a screw conduit configured to receive the bit; a screw feeder tube; a vacuum coupler, and a screw holding assembly. At least a distal portion of the screw feeder tube between a middle region and distal end may be oriented such that a screw can pass therethrough under a force of gravity. The vacuum coupler may be coupled to the middle region of the screw feeder tube, and may be configured to couple to a vacuum generator. The screw holding assembly may be adjacent the screw conduit and may be configured to receive and hold a screw in a position for engagement by the bit.

27 Claims, 5 Drawing Sheets

FIG. 6A
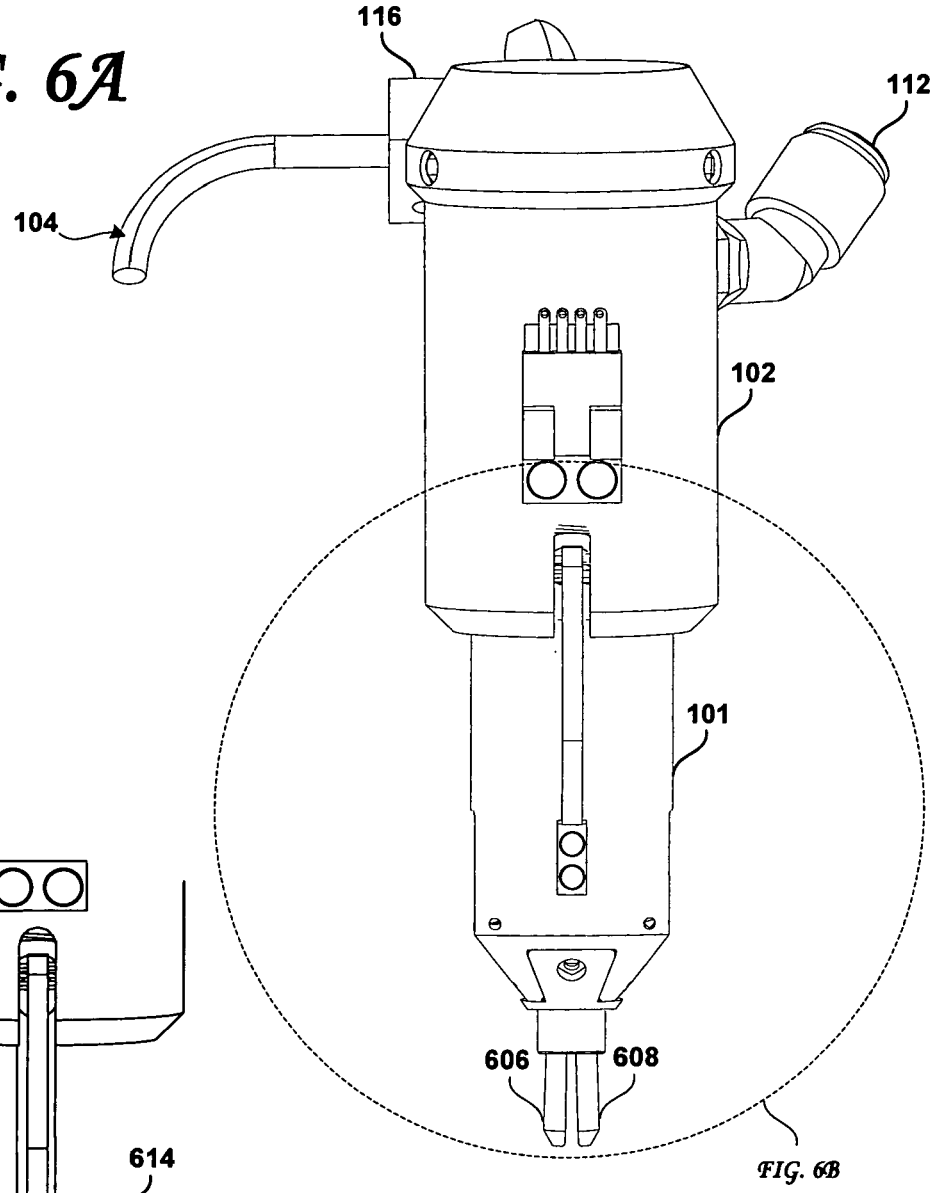
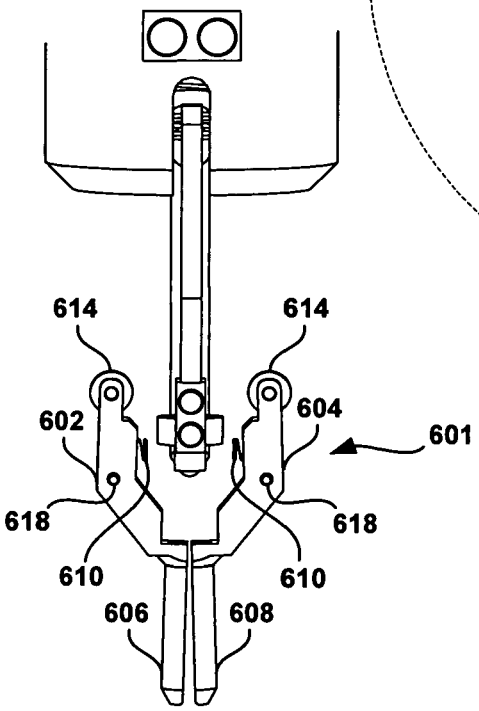
FIG. 6B

METHODS, DEVICES AND SYSTEMS FOR SCREW FEEDING BY VACUUM AND GRAVITY

BACKGROUND OF THE INVENTION

1. Field of the Invention

The present invention relates generally to screwdrivers, and in particular to methods, devices and systems for feeding screws automatically to an electric screwdriver.

2. Description of the Related Art

The typical hard disk drive includes a head disk assembly (HDA) and a printed circuit board assembly (PCBA) attached to a disk drive base of the HDA. The head disk assembly includes at least one magnetic disk, a spindle motor for rotating the disk, and a head stack assembly (HSA). The spindle motor includes a spindle motor hub that is rotatably attached to the disk drive base.

Advances in the hard disk drive industry have led to the incorporation of disk drives into a variety of hand held devices, such as music players, cameras and PDAs. The small size of such devices has led to a corresponding reduction in the form factor of high capacity hard disk drives. Conversely, the ability of manufacturers to introduce ever smaller drives has led to their incorporation in ever widening classes of electronic devices and to the development of entirely new classes of devices. Form factors have steadily shrunk from 5.25", 3.5", 2.5", 1.8" and now to 1 inch and smaller drives.

As a result of such continuing miniaturization, many of the constituent components of the drives have become too small to be consistently, speedily and reliably handled by human hands. For example, screws that are used in such small form factor drives include so-called M1 screws, which have a diameter of just 1 mm and a head height of just 0.2 mm. These screws are difficult to pick up, couple to a screwdriver and drive into a selected threaded hole in a disk drive. Such problems have led to the development of electric screw driving machines. Many existing electric screwdrivers in the factory require the operator to manually or vacuum pick the screws from a shaker tray before driving them on designated fixtures. That is, before driving a screw, the operator must swing the electric screwdriver over to the shaker tray. After the electric screwdriver is in position over the shaker tray, the operator must cause a screw to couple to the bit of the electric screwdriver and swing the electric screwdriver and coupled screw in position over the disk drive to drive the screw therein. After the screw has been driven, the operator must once again swing the electric screwdriver over the shaker tray to couple another screw to the electric screwdriver. The repetitive process of swinging the electric screwdriver over the shaker tray, picking up a screw and swinging the screwdriver back over the disk drive (which is sometimes called a "pick-and-place" process) is time consuming (and, therefore, decreases the manufacturing line's yield). Improving upon the conventional method of picking up screws from a shaker tray would decrease the screw driving cycle time, as well as operator fatigue.

Electric screwdrivers with automatic screw feeding systems do exist, but typically rely on a blow feed system to feed the screws to the screwdriver. Such blow feed systems use a blast of air to carry the screw from its source to a position in which it may be engaged by the screwdriver's bit. This blast of air typically escapes from the screwdriver in the vicinity of the screwdriver's bit and may carry particulate matter and other contaminants to the work area. Electric screwdrivers featuring blow feed systems are, therefore, unsuitable for environments in which it is desired to minimize such contamination, such as clean room environments, for example. What are needed, therefore, are electric screwdrivers having automatic screw feeding mechanisms that are suitable for use in clean room environments and other environments in which it is desired to minimize contamination.

SUMMARY OF THE INVENTION

According to an embodiment of the present invention, an adaptor for feeding screws to an electric screwdriver is disclosed. The adaptor may include a body portion configured to couple to the electric screwdriver, the body portion defining a screw conduit; a screw feeder tube, the screw feeder tube defining a proximal end configured to receive a screw, a middle region and a distal end that is coupled to the screw conduit, at least a distal portion of the screw feeder tube defined between the middle region and distal end being oriented such that the screw passes therethrough under a force of gravity; a vacuum coupler adjacent the middle region of the screw feeder tube, the vacuum coupler being configured to couple to a vacuum generator to generate a vacuum within the screw feeder tube; and a screw holding assembly adjacent the screw conduit and configured to receive and hold a screw in a position for engagement by the electric screwdriver.

The adaptor may further include a sensor assembly. The sensor assembly may be operable to control the vacuum generator to turn the vacuum on when the screw is engaged by the electric screwdriver. The adaptor may further include a compression spring fitted within the body portion, and the compression spring may be biased to move the electric screwdriver out of the screw conduit. The screw feeder tube may define one or more perforations, and the vacuum coupler may adjacent to the perforation or perforations. The body portion, the screw feeder tube, the vacuum generator and the screw holding assembly may be collectively operable to prevent air from flowing into a clean room environment from the adaptor. The screw holding assembly may be configured to selectively pivot between a first configuration that is operable to receive and hold the screw and a second configuration that is operable to allow the screw to pass therethrough. The screw holding assembly may include one or more springs biased to return the screw holding assembly to the first configuration.

According to another embodiment, the present invention is a method of feeding screws to an electric screwdriver. The method may include steps of providing and coupling an automatic screw feeding adaptor to the electric screwdriver; generating a vacuum within the adaptor sufficient to draw a screw from a proximal end to a middle region of the adaptor; shutting off the vacuum and releasing the screw to fall to a distal end of the adaptor; and receiving and holding the screw at the distal end of the adaptor until the screwdriver engages the screw.

A step of generating the vacuum within the adaptor may be carried out to draw another screw from the proximal end to the middle region after the receiving and holding step. Steps may be carried out to detect when the screw is received at the distal end, and, upon detecting that the screw is received, to generate the vacuum within the adaptor to draw another screw from the proximal end to the middle region. A step of maintaining the vacuum within the adaptor may be carried out at least until the screwdriver has retracted from the distal end of the adaptor. The released screw may fall to the distal end through force of gravity. The method may further include a step of signaling an operator of the screwdriver when the screw is received and held.

Yet another embodiment of the present invention is an electric screwdriver with automatic screw feeding, The electric screwdriver may include a shaft defining a bit; a body portion, the body portion defining a screw conduit configured to receive the bit; a screw feeder tube, the screw feeder tube defining a proximal end configured to receive a screw, a middle region and a distal end that is coupled to the body portion, at least a distal portion of the screw feeder tube defined between the middle region and distal end being oriented generally vertically; a vacuum coupler adjacent the middle region of the screw feeder tube, the vacuum coupler being configured to couple to a vacuum generator to generate a vacuum within the screw feeder tube; and a screw holding assembly adjacent the screw conduit and configured to receive and hold the screw in a position for engagement by the bit.

The screwdriver may further include a sensor assembly, the sensor assembly being operable to control the vacuum generator to turn the vacuum on when the screw is engaged by the bit. A compression spring may be fitted within the body portion, and the compression spring may be biased to move the bit out of the screw conduit. The screw feeder tube may define one or more perforations, and the vacuum coupler may be adjacent the perforation or perforations. The body portion, the screw feeder tube, the vacuum generator and the screw holding assembly may be collectively operable to prevent air from flowing into a clean room environment. The screw holding assembly may be configured to selectively pivot between a first configuration that is operable to receive and hold the screw and a second configuration that is operable to allow the received and held screw to pass therethrough. The screw holding assembly may include one or more springs that are operable to return the screw holding assembly to the first configuration.

Still another embodiment of the present invention is a method of driving screws that may include steps of providing an electric screwdriver; generating a vacuum within the screwdriver sufficient to draw a screw from a proximal end to a middle region of the electric screwdriver; shutting off the vacuum and releasing the screw to fall to a distal end of the electric screwdriver; receiving and holding the screw at the distal end; advancing a bit to the distal end and engaging the received and held screw; and driving the engaged screw.

A step of retracting the bit from the distal end after the driving step may be carried out. The method may also include a step of generating the vacuum within the screwdriver to draw another screw from the proximal end to the middle region after the receiving and holding step. The method may also include steps of detecting when the screw is received at the distal end, and, upon detecting that the screw is received, generating the vacuum within the electric screwdriver to draw another screw from the proximal end to the middle region. The method may also include a step of maintaining the vacuum within the electric screwdriver at least until the bit has been retracted. The released screw may fall to the distal end through force of gravity. A step of signaling an operator of the screwdriver when the screw is received and held may also be carried out.

BRIEF DESCRIPTION OF THE DRAWINGS

FIG. 6A shows an adaptor for feeding screws to an electric screwdriver, according to another embodiment of the present invention.

FIG. 6B shows a detail view of a portion of the adaptor of FIG. 6A, with the first body portion removed therefrom, to show selected internal structures thereof.

DESCRIPTION OF THE PREFERRED EMBODIMENTS

Figure 1:
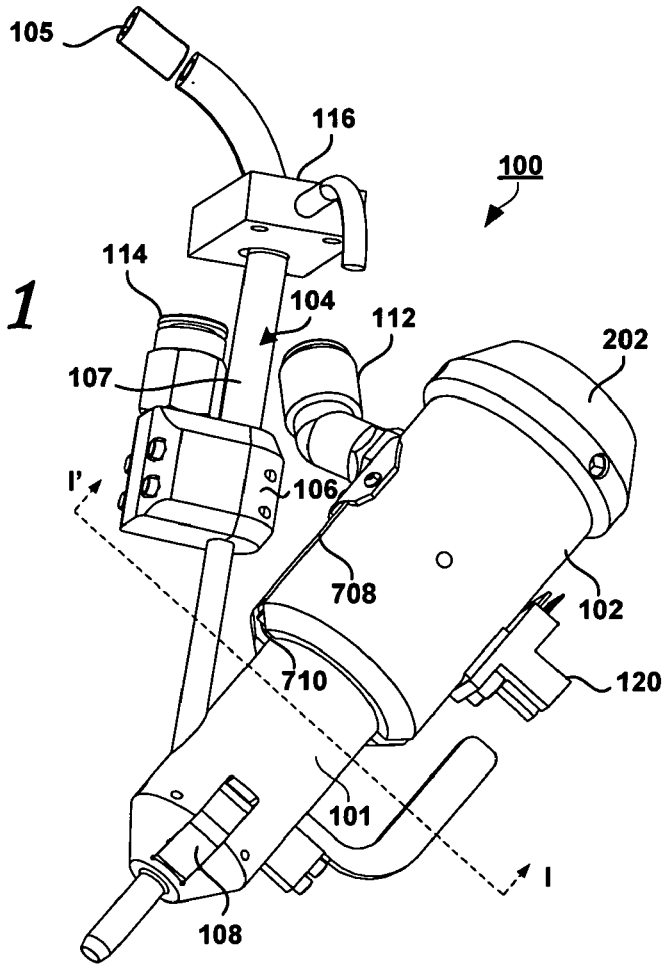
FIG. 1 shows an adaptor for feeding screws to an electric screwdriver, according to an embodiment of the present invention.
Figure 2:
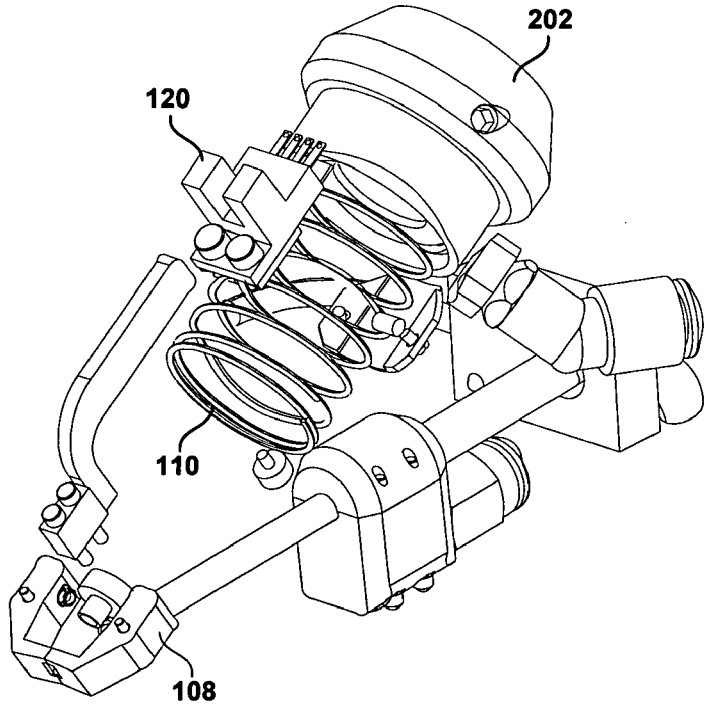
FIG. 2 shows the adaptor for feeding screws of FIG. 1 with the first and second body portions removed therefrom, to show some of the internal structure thereof.
Figure 3:
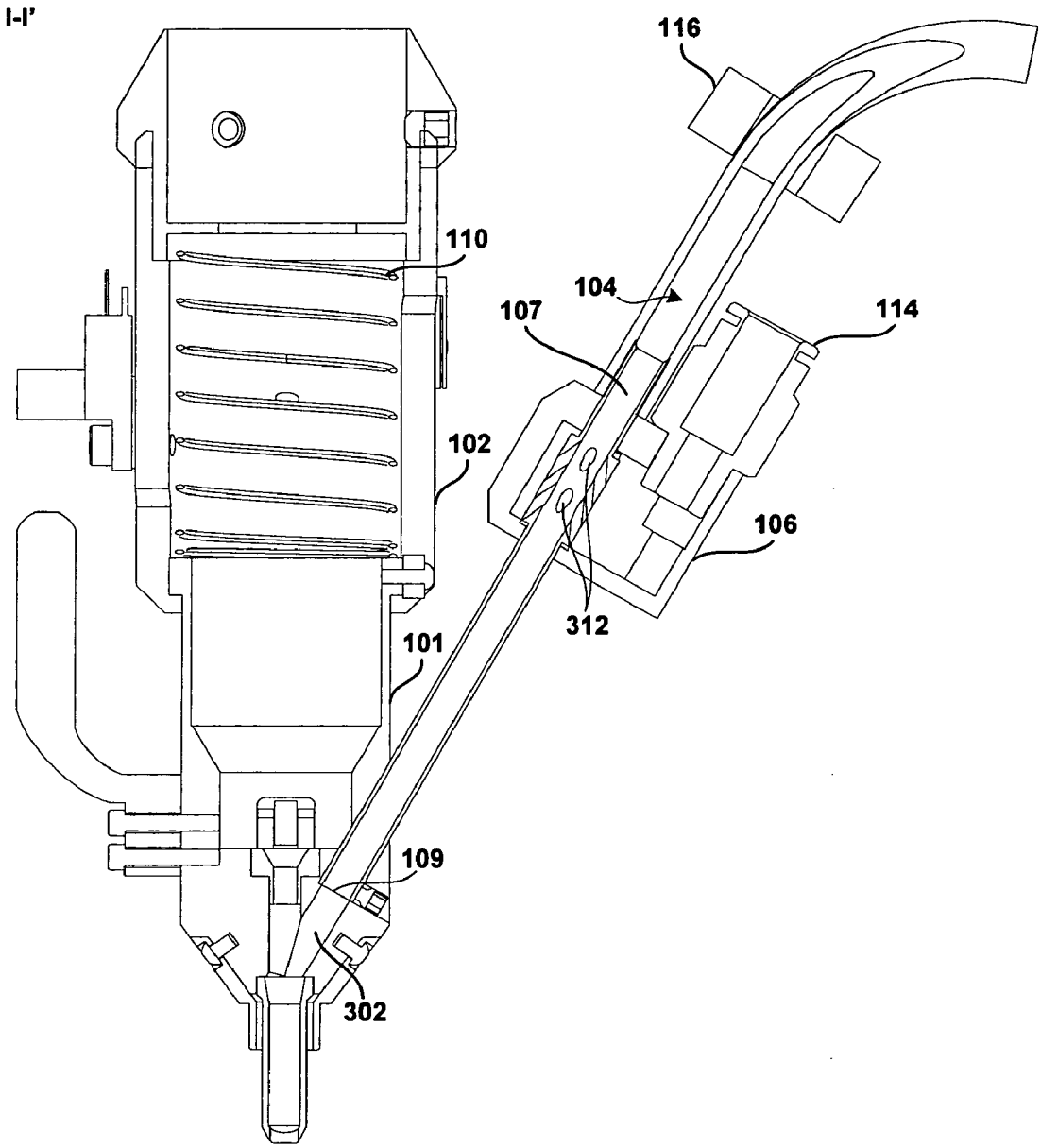
FIG. 3 shows a cross-sectional view of the adaptor of FIG. 1, taken along lines I—I' of FIG. 1.

FIG. 1 shows an adaptor 100 for feeding screws to an electric screwdriver, according to an embodiment of the present invention. FIG. 2 shows the adaptor 100, with body portions removed therefrom, to show selected internal structures thereof, and FIG. 3 is a cross-sectional view of the adaptor 100 taken along lines I—I' of FIG. 1. Considering now FIGS. 1, 2 and 3 collectively, the adaptor 100 is configured to couple to an electric screwdriver (shown in FIGS. 7A and 7B) and may include a first body portion 101 and a second body portion 102. Embodiments of adaptors constructed according to embodiments of the present invention may be configured to couple to electric screwdrivers manufactured by, for example, Hiyashi or Delvo. The first body portion 101 of the adaptor 100 may define a screw conduit, shown at 302 in FIG. 3. According to an embodiment of the present invention, when the adaptor 100 is in use, the screw conduit 302 is preferably in an orientation to enable screws to pass therethrough under the force of gravity alone. As would be well understood by those of skill in the art, more or fewer body portions may be used to construct the adaptor 100 according to embodiments of the present invention. Moreover, although described in terms of separately constructed pieces, many of the pieces described herein may be formed as a unitary construction according to other embodiments.

A screw feeder tube 104 (formed of polyurethane, for example) may be coupled to the first body portion 101. Advantageously, all or selected portions of the screw feeder tube 104 may be partially transparent, to enable the operator to see the screw as it travels through the screw feeder tube 104. The screw feeder tube 104 may define a proximal end 105, a middle region 107 and a distal end 109. The proximal end 105 may be coupled to a source of screws and may be configured to receive screws. The distal end 109 of the screw feeder tube 104 may be coupled to the first body portion 101 and to the screw conduit 302. According to an embodiment of the present invention, at least a distal portion of the screw feeder tube 104 defined between the middle region 107 and distal end 109 may be oriented generally vertically, so as to enable screws to pass therethrough under the force of gravity. As used herein, the phrase, generally vertically, may be contrasted with a horizontal orientation, wherein a screw would be unable to move through the tube 104 under the force of gravity, and does not imply a perfectly vertical orientation. As would be well understood by those skilled in the art, the screw feeder tube 104 may be made of any suitable material and is preferably sized to allow a single screw to closely fit therethrough.

A vacuum generator (not shown) may be coupled to the middle region 107 of the screw feeder tube 104 by a vacuum coupler (for example, by a vacuum bracket 106) disposed adjacent the middle region 107 of the screw feeder tube 104. The vacuum generator (which forms no part of the embodiments of the present invention described herein) may be configured to selectively generate a vacuum within the screw feeder tube 104 that is sufficient to draw a screw from the proximal end 105 (shown in FIG. 1) of the screw feeder tube 104 to the middle region 107 thereof. It has been found that the screw feeder tube and the vacuum generator may be configured such that a screw may travel through a 0.5 m length of the screw feeder tube 104 in less than 0.5 seconds. The vacuum generator may comprise any type of vacuum generator well known to those of skill in the art, and may provide vacuum via many vacuum hoses to a number of different devices.

After the screw reaches the middle region 107 of the screw feeder tube 104, the vacuum may be shut off, enabling the screw to travel (preferably under the force of gravity alone) to the distal end 109 of the screw feeder tube 104. Having reached the distal end 109 of the screw feeder tube 104, the screw may then enter the screw conduit 302. As the screw conduit 302 is preferably oriented such that the screw may travel therethrough under the force of gravity alone when the adaptor or the electric screwdriver is in use, the screw may fall to a screw holding assembly 108 that is adjacent the screw conduit 302. In a preferred embodiment, the screw holding assembly may be coupled to the screw conduit 302. The screw holding assembly 108, according to an embodiment of the present invention, may be configured to receive and hold the screw in a position for engagement by the electric screwdriver.

Figure 7A:
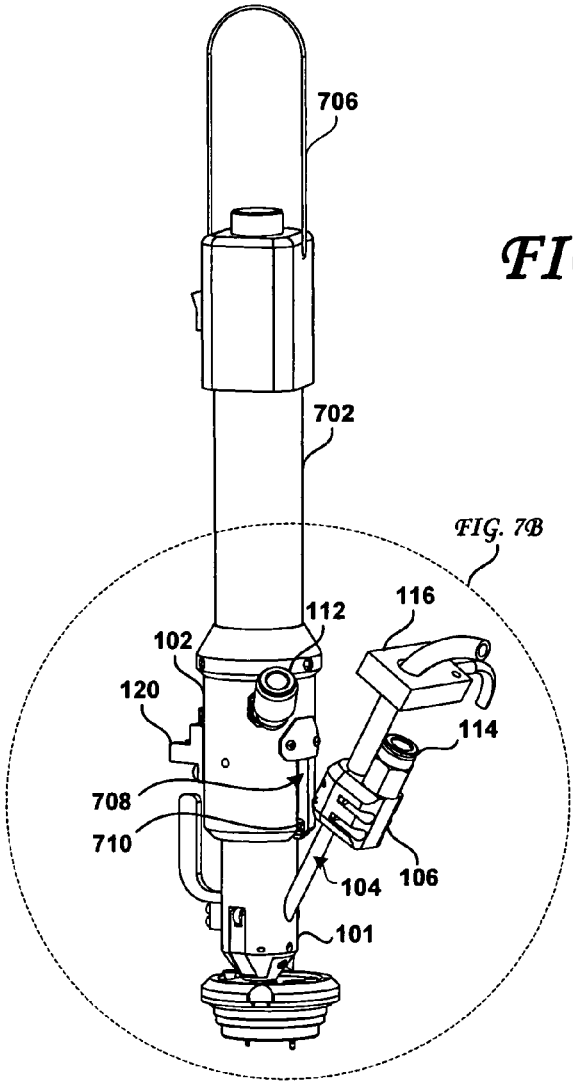
FIG. 7A shows an electric screwdriver with automatic screw feeding functionality, according to another embodiment of the present invention.

According to one embodiment of the present invention, the screwdriver (shown at 702 in FIGS. 7A and 7B) may be coupled to the adaptor 100. Alternatively, the adaptor 100 may form an integral part of the electric screwdriver 702. In the embodiment shown in FIG. 1, the electric screwdriver is coupled to the adaptor, and, in particular, is coupled to the second body portion 102. The first and second body portions 101, 102 may be configured to slide relative to one another, as the screwdriver bit is driven forward and backward. At least the second body portion may include an outer member formed of Aluminum (for example) and an inner member formed of, for example, Turcite®, an internally lubricated, low water absorption material that is suitable for applications having exacting wear and friction requirements. Other hard plastics such as Pomolux®, for example, may also be used. As best shown in FIG. 7A (but also shown in FIG. 1), the second body portion 102 may define a slot 708, and the first body portion 101 may define a bearing 710 that is aligned with and dimensioned to fit within the slot 708. During operation, as the screwdriver's bit is advanced and retracted, the second body portion 102 may slide over the first body portion 101, guided and facilitated by the aligned and cooperating slot 708 and bearing 710.

FIG. 2 shows the adaptor for feeding screws to an electric screwdriver of FIG. 1, with the first and second body portions 101, 102 removed therefrom, to show some of the internal structure. As shown in both FIGS. 1 and 2, a sleeve 202 may be coupled to the second body portion. The sleeve 202 may be configured to receive the screwdriver and to secure the screwdriver to the adaptor 100 such that the shaft 704 of the screwdriver extends within the adaptor 100. The sleeve 202 may be threaded to enable the adaptor to be tightened onto the screwdriver. Preferably, the threads within the sleeve 202 may be disposed and configured such as to counter the angular force imposed thereon during the screw driving process, to prevent the adaptor from loosening as screws are tightened within the threaded hole of a disk drive, for example.

The adaptor may also be provided with a compression spring 110. Compression spring 110 may be, for example, part number B17-188 available from Century Spring corporation of Los Angeles, Calif. The compression spring 110 may abut the sleeve 202 and may elastically bias the screwdriver in a retracted configuration away from the screw conduit, such that the screwdriver bit 706 (see FIGS. 5B and 5C) is not engaged with the screw 502. An operator (or an automatic system) may then apply (e.g., downwardly directed) pressure on the screwdriver/adaptor assembly to bring the screwdriver bit 706 into engagement with the screw 502 received within the screw holding assembly 108. After the screw 502 has been driven into the disk drive, the operator or automatic system may release the pressure on the screwdriver/adaptor assembly, whereupon the compression spring 110 causes the screwdriver to return to its retracted configuration in which the bit 706 is moved away from the screw holding assembly 108.

The adaptor 100 may also include a vacuum fitting 112 to enable internal cleaning of the adaptor/screwdriver assembly. The vacuum fitting 112 allows the adaptor to be cleaned of any particulates that may have accumulated therein after extended periods of use.

According to an embodiment of the present invention, the middle region 107 of the screw feeder tube may define one or more perforations 312, as shown in the cross-sectional view of FIG. 3. The middle region of the screw feeder tube may, for example, be formed of or include Aluminum. A vacuum bracket 106 may be fitted to the middle region 107 of the screw feeder tube 104, over the perforations 312. The vacuum bracket 106 preferably forms a substantially air tight seal around the middle region 107 of the screw feeder tube 104. A vacuum bracket fitting 114 may be coupled to the vacuum bracket 106, whereby the adaptor is coupled to the vacuum generator (not shown) via, for example, vacuum tubing. A vacuum may then be created within the screw feeder tube 104 through the perforations 312.

The screw holding assembly 108 may be configured to receive a screw falling within the screw conduit 302 and to receive and hold the screw in a position for engagement by the electric screwdriver. That is, the screw holding assembly 108 may be configured to receive a screw 502 and position the received screw 502 in an upright position, with the head thereof facing the free end of the shaft 704 of the screwdriver 702.

FIGS. 4, 5A, 5B and 5C show an exemplary embodiment of the screw holding assembly 108. As shown therein, the screw holding assembly 108 may include a first screw catchment 402 and a second screw catchment 404. The first and second screw catchments 402, 404 may be provided with a pair of pivot dowels 406, about which they may pivot, as suggested by the arrows 502 in FIG. 5C. The screw holding assembly 108 may be configured to assume a first configuration (shown in FIGS. 4, 5A and 5B) in which the received screw 502 may be received and held and a second configuration (shown in FIG. 5C) in which the first and second screw catchments 402, 404 pivot about their respective pivot dowels 406 and allow the received screw 502 to pass therethrough and then be driven into a corresponding threaded hole by the screwdriver. As shown, the first and second screw catchments 402, 404 may be biased to the first configuration by respective screw catchment springs 408. Suitable screw catchment springs 408 may be obtained from Century Spring Corporation, part number 70058S, for example.

Figure 4:
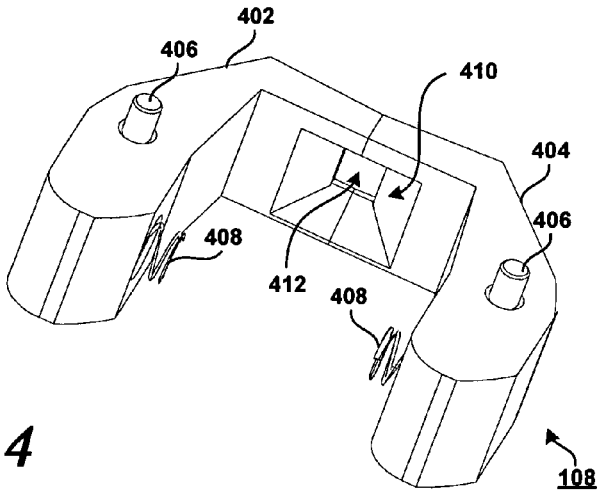
FIG. 4 shows a screw holding assembly according to an embodiment of the present invention.
Figure 5A:
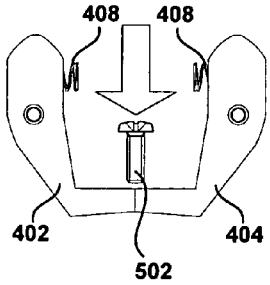
FIG. 5A shows the screw holding assembly of FIG. 4 in a first configuration, to illustrate aspects of the operation thereof.
Figure 5B:
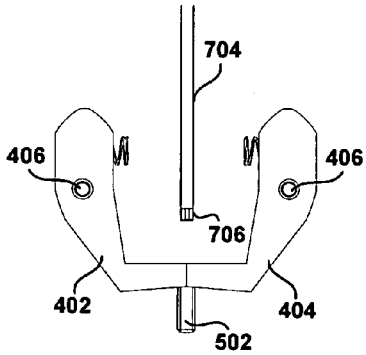
FIG. 5B shows the screw holding assembly of FIG. 4 in a second configuration, to illustrate further aspects of the operation thereof.

In operation, a screw 502 may be drawn toward the perforations 312 within the middle region 107 of the screw feeder tube 104 by the force of vacuum from a shaker tray, for example, holding a plurality of screws. When the vacuum is turned off or the force thereof sufficiently decreased, the screw 502, no longer held by the vacuum, falls through a distal portion of the screw feeder tube 104 under the force of gravity, toward the distal end 109 of the screw feeder tube. The falling screw 502 may then be received and held by the screw holding assembly 108, which is in its first configuration, as shown in FIGS. 4, 5A and 5B. The screw 502 may rest within the angled depression 410 defined within the screw catchments 402, 404, with the head of the screw 502 being retained therein and the shaft of the screw allowed to extend through an opening 412 defined within the angled depression 410 formed by both screw catchments 402, 404 in the first configuration, as shown in FIG. 5B.

Figure 5C:
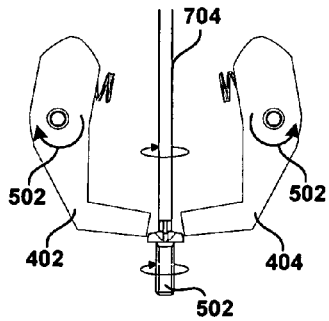
FIG. 5C shows the screw holding assembly of FIG. 4 in a third configuration, to illustrate still further aspects of the operation thereof.

The bit 706 (a Torx® bit, for example) at the free end of the shaft 704 may then be advanced (overcoming the force exerted thereon by the compression spring 110 in the process) toward the head of the screw 502, as shown in FIG. 5B. Thereafter, as shown in FIG. 5C, the bit 706 of the shaft 704 of the screwdriver may engage the screw 502 received within the screw holding assembly 108 and push down on the screw 502. In so doing, the head of the screw 502 may exert a force on the angled surfaces of the angled depression 410, causing the screw catchments 402, 404 to pivot about the pivot dowels 406. As the screw catchments 402, 404 pivot, they release the screw 502, which then may be engaged and driven in an appropriate threaded hole (for example, in a disk drive). After the screw has been driven and the shaft 704 retracted, the screw catchments 402, 404 may return to the first configuration (FIGS. 4, 5A and 5B) under the action of the screw catchment springs 408. Alternatively, as shown, the bit 706 and shaft 704 may have a cross-sectional area smaller than that defined by the opening 412, and the catchments may return to the first configuration after the screw has passed through the opening 412. It is understood that the design and operation of the screw holding assembly 108 may vary from that shown and described herein without, however, departing from the scope of the present invention. For example, in one embodiment, the screw holding assembly 108 may not comprise pivotal members, but its members may instead slide linearly apart upon pressure from the shaft 704.

FIG. 6A shows an adaptor for feeding screws to an electric screwdriver, according to another embodiment of the present invention. FIG. 6B shows a detail view of a portion of the adaptor of FIG. 6A, with the first body portion 101 removed therefrom, to show selected internal structures. FIGS. 6A and 6B show a screw holding assembly 601 of a different design than that shown in FIGS. 1, 4, 5A, 5B and 5C.

As best seen in FIG. 6B, the screw holding assembly 601 may include first and second screw catchments 602, 604. The screw catchments 602, 604 may include screw catchment springs 610 and pivot dowels 618 that operate similarly to their counterpart catchment springs 408 and pivot dowels 406 in FIGS. 4, 5A, 5B and 5C. In addition, this embodiment of the screw holding assembly 601 may include rollers 614, one roller 614 being mounted on each of the screw catchments 602, 604. The rollers 614 facilitate the pivoting of the screw catchments 602, 604 about their respective pivot dowels 618, to enable the screw catchments to smoothly transition between the first configuration in which a received screw is held and the second configuration in which the first and second screw catchments 602, 604 pivot about their respective pivot dowels 618 and allow the received screw to be released and driven by the screwdriver. For example, in one embodiment, a portion of the screwdriver may engage these rollers 614 along an external surface of the body portion as the screw driver lowers towards the captured screw, thus pushing the rollers 614 radially inwards, and pivoting the screw catchments apart at their distal end.

As shown in the embodiment of FIGS. 6A and 6B, each of the screw catchments 602, 604 may include a distal extension 606, 608. Such distal extensions 606, 608 enable the screw to be precisely oriented and aligned with a threaded hole into which the screw is to be driven. That is, when the screw holding assembly 601 assumes its second configuration in which the screw catchments 602, 604 are pivoted about their respective pivot dowels 618 to allow the screw to pass therethrough, and the screw is engaged by the bit of the screwdriver, the distal extensions 606, 608 maintain the engaged screw in the proper orientation while the bit 706 pushes down on the screw to bring the threaded shaft of the screw 502 to the target hole.

The screw holding assemblies 108, 601 are preferably formed of one or more materials having specific properties. For example, the material(s) used for the screw holding assembly 108, 601 preferably should be dimensionally stable after repeated impacts with steel parts. Therefore, Aluminum or polymers (plastics) are not currently preferred, as such material may be too soft to withstand repeated contact with screws without generating unwanted and potentially damaging particulate matter and/or undesirable outgassing. Preferably, the material or materials chosen for the screw holding assembly 108, 601 should be a relatively hard material that is corrosion proof. Accordingly, the screw holding assembly 108, 601 may include hardened SST 440C, as this material satisfies the above-outlined criteria and effectively withstands repeated impacts and contact with the screw heads.

According to an embodiment of the present invention, after a screw has been released from the middle region 107 (by shutting off the suction, for example) and falls (through the force of gravity, for example) within the screw conduit 302 to be received and held by the screw holding assembly 108 or 601, a new screw may be drawn into the screw feeder tube 104 and held at the perforations 312 defined within the middle region 107. That is, after a first screw has been released to the screw holding assembly 108 or 601, a second screw may be drawn into the screw feeder tube 104 and held at the perforations 312 at least until the bit 706 of the screwdriver has finished driving the first screw and retracted sufficiently to clear the screw holding assembly 108 or 601.

Having a screw "on deck" and waiting to be released enables short cycle times between driving successive screws.

Such a sequence of operations may be facilitated, according to an embodiment of the present invention, by providing the adaptor or screwdriver with one or more sensors, such as that shown at 120 in FIGS. 1, 2 and 7A that are configured to indicate the position of bit 706. Suitable sensors may be obtained from, for example, Keyence Corporation of America of Woodcliff Lake, N.J. For example, as soon as the sensor 120 detects that the bit 706 has been sufficiently retracted to enable a new screw to be released from the middle region 107 of the screw feeder tube, the sensor 120 may generate a signal that may be used to shut off (or substantially decrease the vacuum) within the screw feeder tube 104 to allow a new screw to be released into the screw holding assembly 108, 601.

Alternatively, or in addition to the functionality described above, as the bit 706 moves down towards the screw that is held at the screw holding assembly 108 or 601, a (e.g., proximity) sensor 120 may trigger and cause the vacuum generator to turn on. For example, in one embodiment, the sensor assembly may cause the vacuum generator to turn on when the screw is engaged by the screwdriver. Alternatively, the sensor assembly may cause the vacuum generator to turn on and draw another screw, upon detecting that a screw has been received at the distal end of the adaptor. In greater detail, the generated vacuum causes the next screw from the source of screws (e.g., a screw feeder) to travel towards the perforations 312 in the middle region 107 of the screw feeder tube 104. While the bit 706 is driving a screw, the sensor 120 may remain turned on, and the vacuum generator may continue to generate the vacuum within the screw feeder tube. Thus, the suction created by the vacuum generator holds the screw within the middle region 107 until it is needed. After the bit 706 retracts away from the screw holding assembly, the sensor 120 may turn off, thereby indicating that the bit 706 has cleared the screw path. The vacuum may then be turned off, and the screw previously held in the middle region 107 may then be released to travel (preferably solely under the force of gravity) to the screw holding assembly 108 or 601 for the next screw driving cycle.

Figure 7B:
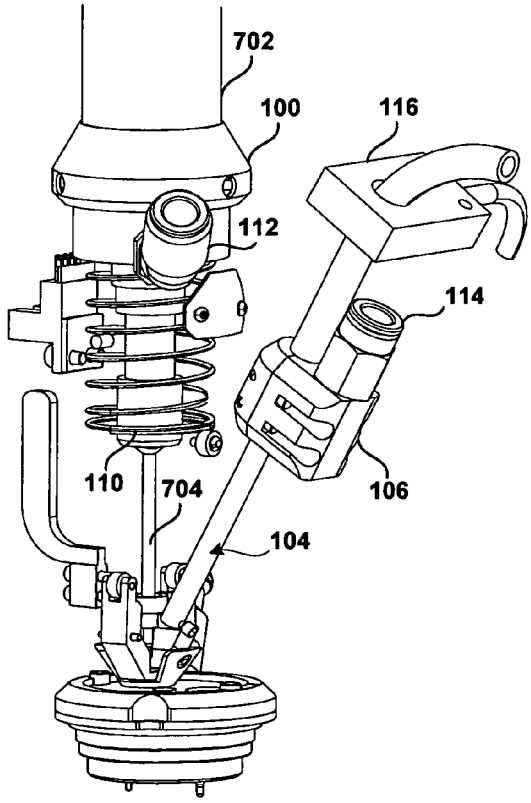
FIG. 7B shows a detail view of a portion of the electric screwdriver of FIG. 7A, with the first and second body portions removed therefrom, to show selected internal structures thereof.

FIG. 7A shows an electric screwdriver with automatic screw feeding functionality, according to another embodiment of the present invention. FIG. 7B shows a detail view of a portion of the electric screwdriver of FIG. 7A, with the first and second body portions 101, 102 removed therefrom, to show selected internal structures thereof. In one embodiment, a screwdriver may be coupled to a removable screw feeding adaptor, as described relative to FIGS. 1 to 6B. Alternatively, the electric screwdriver 702 may be provided with the automatic screw feeding functionality shown and described above, such that the functionality of the above-described adaptor forms an integral part of an electric screwdriver with automatic screw feeding.

The electric screwdriver shown in FIGS. 7A and 7B may be coupled to a vacuum generator and to a source of screws (e.g., a screw feeder), as described above. The electric screwdriver may then be hung from a support such as that shown at 706, to enable the electric screwdriver to be conveniently placed within easy reach of an operator, and to insure that the electric screwdriver is maintained in a substantially vertical orientation to facilitate the gravity feeding of the screws when the vacuum is turned off to release a screw.

As an operator-interface feedback mechanism, a sensor 116 (see FIGS. 1, 3, 6A and 7B) may also be attached to the screw feeder tube 104. The sensor 116 may be configured to detect the passage of a (e.g., metal) screw within the screw feeder tube 104. This sensor 116 may detect the presence of the screw and may, in turn, signal the operator to proceed with the next screw driving.

For example, the sensor 116 may be coupled to a light emitting diode (L.E.D), light bulb or sound source that is activated when a screw is detected in the screw feeder tube 104. For example, a lighted L.E.D. may signal to the operator to proceed to the next screw driving. Such an L.E.D. may advantageously be configured to turn off once the sensor is again triggered. In another embodiment, the sensor 120, used as described above to detect the location of a received and held screw, may also provide a signal to an operator of the location of the screw.

Advantageously, the embodiments of the present invention eliminate the need to pick screws manually from a shaker tray, as well as the need for an intermediate screw-presenting device between the source of screws and the screwdriver. An operator needs only to perform an up and down screw-driving motion, as the screwdriver need not be swung over to the source of screws to pick up the next screw to be driven, which results in a faster screw driving cycle time and higher manufacturing line yields as compared with conventional pick-and-screw-driving methods. Moreover, as the screw feeding mechanisms described above do not rely on a complete blow feeding system to feed screws to the screwdriver (relying instead primarily on suction and gravity to feed screws), embodiments of the present invention are ideally suited to clean room manufacturing environments. Indeed, as the screws are fed by a combination of suction and gravity, substantially no air flow is induced out of the distal end of the adaptor or screwdriver, which minimizes the contamination of the surrounding environment, as compared with conventional blow fed systems in which blasts of air are emitted from the distal end of the screwdriver. Regular cleaning of the adaptor or screwdriver via the vacuum fitting 112 of the present adaptor or screwdriver also reduces the amount of particulate matter or other impurities that may accumulate within the adaptor or screwdriver over time and potentially contaminate the surrounding environment.

As noted above, embodiments of the present invention may be readily adapted to automatic screw driving stations that do not require a human operator. When embodiments of the present invention are adapted to automated screw driving stations, the cycle time for such automated machines also decreases, thereby increasing their yield. When embodiments of the present invention are incorporated into such automatic screw driving stations, the design thereof may be simplified and the cost reduced, as the robotic apparatus need no longer provide for picking up screws from a shaker tray.

We claim:

1. An adaptor for feeding screws to an electric screwdriver, comprising:

a body portion configured to couple to the electric screwdriver, the body portion defining a screw conduit;

a screw feeder tube, the screw feeder tube defining a proximal end configured to receive a screw, a middle region and a distal end that is coupled to the screw conduit, at least a distal portion of the screw feeder tube defined between the middle region and distal end being oriented such that the screw passes therethrough under a force of gravity;

a vacuum coupler adjacent the middle region of the screw feeder tube, the vacuum coupler being configured to couple to a vacuum generator to generate a vacuum within the screw feeder tube; and a screw holding assembly adjacent the screw conduit and configured to receive and hold a screw in a position for engagement by the electric screwdriver.

2. The adaptor of claim 1, further comprising a sensor assembly, the sensor assembly being operable to control the vacuum generator to turn the vacuum on when the screw is engaged by the electric screwdriver.

3. The adaptor of claim 1, further including a compression spring fitted within the body portion, the compression spring being biased to move the electric screwdriver out of the screw conduit.

4. The adaptor of claim 1, wherein the screw feeder tube defines at least one perforation, and wherein the vacuum coupler is adjacent the at least one perforation.

5. The adaptor of claim 1, wherein the body portion, the screw feeder tube, the vacuum generator and the screw holding assembly are collectively operable to prevent air from flowing into a clean room environment from the adaptor.

6. The adaptor of claim 1, wherein the screw holding assembly is configured to selectively pivot between a first configuration that is operable to receive and hold the screw and a second configuration that is operable to allow the screw to pass therethrough.

7. The adaptor of claim 6, wherein the screw holding assembly includes at least one spring biased to return the screw holding assembly to the first configuration.

8. A method of feeding screws to an electric screwdriver, comprising the steps of:

providing and coupling an automatic screw feeding adaptor to the electric screwdriver;

generating a vacuum within the adaptor sufficient to draw a screw from a proximal end to a middle region of the adaptor;

shutting off the vacuum and releasing the screw to fall to a distal end of the adaptor; and receiving and holding the screw at the distal end of the adaptor until the screwdriver engages the screw.

9. The method of claim 8, further including a step of generating the vacuum within the adaptor to draw another screw from the proximal end to the middle region after the receiving and holding step.

10. The method of claim 8, further including steps of detecting when the screw is received at the distal end, and, upon detecting that the screw is received, generating the vacuum within the adaptor to draw another screw from the proximal end to the middle region.

11. The method of claim 10, further including a step of maintaining the vacuum within the adaptor at least until the screwdriver has retracted from the distal end of the adaptor.

12. The method of claim 8, wherein the released screw falls to the distal end through force of gravity.

13. The method of claim 8, further including a step of signaling an operator of the screwdriver when the screw is received and held.

14. An electric screwdriver with automatic screw feeding, comprising:

a shaft defining a bit;

a body portion, the body portion defining a screw conduit configured to receive the bit;

a screw feeder tube, the screw feeder tube defining a proximal end configured to receive a screw, a middle region and a distal end that is coupled to the body portion, at least a distal portion of the screw feeder tube defined between the middle region and distal end being oriented generally vertically;

a vacuum coupler adjacent the middle region of the screw feeder tube, the vacuum coupler being configured to couple to a vacuum generator to generate a vacuum within the screw feeder tube; and a screw holding assembly adjacent the screw conduit and configured to receive and hold the screw in a position for engagement by the bit.

15. The screwdriver of claim 14, further comprising a sensor assembly, the sensor assembly being operable to control the vacuum generator to turn the vacuum on when the screw is engaged by the bit.

16. The screwdriver of claim 14, further including a compression spring fitted within the body portion, the compression spring being biased to move the bit out of the screw conduit.

17. The screwdriver of claim 14, wherein the screw feeder tube defines at least one perforation, and wherein the vacuum coupler is adjacent the at least one perforation.

18. The screwdriver of claim 14, wherein the body portion, the screw feeder tube, the vacuum generator and the screw holding assembly are collectively operable to prevent air from flowing into a clean room environment.

19. The screwdriver of claim 14, wherein the screw holding assembly is configured to selectively pivot between a first configuration that is operable to receive and hold the screw and a second configuration that is operable to allow the received and held screw to pass therethrough.

20. The screwdriver of claim 19, wherein the screw holding assembly includes at least one spring that is operable to return the screw holding assembly to the first configuration.

21. A method of driving screws, comprising the steps of:

providing an electric screwdriver;

generating a vacuum within the screwdriver sufficient to draw a screw from a proximal end to a middle region of the electric screwdriver;

shutting off the vacuum and releasing the screw to fall to a distal end of the electric screwdriver;

receiving and holding the screw at the distal end;

advancing a bit to the distal end and engaging the received and held screw; and driving the engaged screw.

22. The method of claim 21, further including a step of retracting the bit from the distal end after the driving step.

23. The method of claim 21, further including a step of generating the vacuum within the screwdriver to draw another screw from the proximal end to the middle region after the receiving and holding step.

24. The method of claim 21, further including steps of detecting when the screw is received at the distal end, and, upon detecting that the screw is received, generating the vacuum within the electric screwdriver to draw another screw from the proximal end to the middle region.

25. The method of claim 24, further including a step of maintaining the vacuum within the electric screwdriver at least until the bit has been retracted.

26. The method of claim 21, wherein the released screw falls to the distal end through force of gravity.

27. The method of claim 21, further including a step of signaling an operator of the screwdriver when the screw is received and held.

* * * * *